US006513442B1

(12) United States Patent
Miller et al.

(10) Patent No.: US 6,513,442 B1
(45) Date of Patent: Feb. 4, 2003

(54) FOLDABLE CONTAINER FOR VEHICLES

(75) Inventors: Haim Miller, Haifa (IL); Igal Zimerman, Rehovot (IL)

(73) Assignee: Mifned Ltd., Rehovot (IL)

( * ) Notice: Subject to any disclaimer, the term of this patent is extended or adjusted under 35 U.S.C. 154(b) by 0 days.

(21) Appl. No.: 09/806,822

(22) PCT Filed: Jan. 14, 1999

(86) PCT No.: PCT/IL99/00009

§ 371 (c)(1),
(2), (4) Date: May 21, 2001

(87) PCT Pub. No.: WO00/20303

PCT Pub. Date: Apr. 13, 2000

(30) Foreign Application Priority Data

Oct. 6, 1998 (IL) ..... 126467

(51) Int. Cl.[7] ..... B65D 19/38
(52) U.S. Cl. ..... 108/53.1
(58) Field of Search ..... 108/55.1, 55.5, 108/53.1, 53.3, 51.11

(56) References Cited

U.S. PATENT DOCUMENTS

| | | | | |
|---|---|---|---|---|
| 3,620,388 A | | 11/1971 | Mansson | |
| 3,735,713 A | * | 5/1973 | Glassmeyer | 108/55.1 X |
| 4,964,349 A | * | 10/1990 | Bishop | 108/55.1 |
| 5,639,174 A | | 6/1997 | Gonska | |
| 5,755,472 A | * | 5/1998 | Clive-Smith | 108/53.1 X |
| 6,006,675 A | * | 12/1999 | Heil | 108/55.3 |
| 6,006,676 A | * | 12/1999 | Creek et al. | 108/55.3 |
| 6,263,806 B1 | * | 7/2001 | Heil | 108/55.3 |

FOREIGN PATENT DOCUMENTS

| | | |
|---|---|---|
| GB | 2 120 211 | 11/1983 |
| GB | 2 294 453 | 5/1996 |
| GB | 2 295 381 | 5/1996 |
| WO | 81 01997 | 7/1981 |

* cited by examiner

*Primary Examiner*—Jose V. Chen
(74) *Attorney, Agent, or Firm*—Lowe Hauptman Gilman & Berner, LLP

(57) ABSTRACT

The present disclosure describes a sea/land going container for the transportation of a vehicle with dimensions and structure such that two of these sea/land containers piled one on top of the other form one sea/land going container with two levels of the dimensions and structure of a sea/land going container required by ISO standards. The sea/land going container, according to the present disclosure, comprised of a transportation platform (1) to carry the vehicle during transportation, rail depression (4) of the transportation platform on which the wheels of the vehicle are inserted to increase the maximum possible height for transportation in such a sea/land going container and for the purpose of anchoring the vehicle during transportation, four beams (2) are installed in the corners of the transportation platform in a force structure enabling the loading of more sea/land going containers with a load capacity of 30 tons and connectors (7) complying with ISO standards in quantity and locations determined by the standard for connecting the sea/land going containers one to the other for loading purposes and connecting to adjacent sea/land going containers or to structures of transportation.

20 Claims, 7 Drawing Sheets

FOLDABLE CONTAINER FOR VEHICLES

FIELD OF INVENTION

The present invention is in the field of transportation and in particular transportation by sea. To be more precise, the present invention is in the field of transportation by sea/land going containers.

For many years transportation by sea has been based on transportation in sea/land going containers. The sea/land going container is a standard unit of dimensions and strength defined by ISO STANDARDS. The standard dimensions of the sea/land going containers enable uniform handling and transportation. The sea/land going containers can be piled one on top of the other and coupled so that one sea/land going container is connected to the other and to the handling platform. Today, sea transportation uses sea/land going containers that comply with ISO STANDARDS.

BACKGROUND OF THE INVENTION

Various attempts were made to construct containers for transportation of vehicles.

WO 81/01997 describes a vehicle housing apparatus for transporting vehicles by sea, which has a supporting plate capable of carrying a plurality of vehicles, a pair of metallic rails mounted at both sides of the supporting plate, and coupling joints attached to the upper and the lower surfaces of the respective rails in the vicinities of both ends thereof. The apparatus disclosed in disadvantageous since it does not comply with ISO STANDARDS 668 1AAA and 1CC.

U.S. Pat. No. 5,639,174 discloses a stackable cargo unit for carrying one or more vehicles comprising a wing able ramp by which the vehicles roll on or off the unit, a lower frame, one or more elongated members of the frame capable of bearing the vehicle, a terminus fixed to the lower frame, a floating block rotatably and slidably connected to terminus and an ear at one end of the post, the ear rotatably and slidably connected to the floating block. The cargo unit disclosed is useful for carrying heavy vehicles such as ships, trucks and trains. The structural features comprising the cargo unit includes a ramp which requires the operation of accessory devices such as a crane. Furthermore, it is not clear to which ISO STANDARD does the invention relate.

Currently, the dimensions and strength of the sea/land going containers are determined according the ISO standards, in order to retain the uniformity of transportation standards around the world.

The sea/land going container ISO STANDARDS define storage space. The standards define the external dimensions and the load of a standard sea/land going container The data is defined in ISO STANDARD 668:1988/AMD.1.1993.E (page 3 Table 2)

The data for containers is defined as follows:

(a) 1AAA ("HIGH CUBE" 40 feet):

External Length, L=12,192 mm (40 feet)

External width, W=2,438 mm (8 feet)

External Height, H=2,896 (9 feet and 6 inch)

Maximal load, Gross Mass (GrW)=30,480 Kg (67,200 Lbs)

Weight, TARE=3,900 Kg (8,600 Lbs)

(b) 1CC (20 feet):

External Length, L=6,058 mm (19 feet and 10¼ inch)

External width, W=2,438 mm (8 feet)

External Height, H=2,591 (8 feet and 6 inch)

Maximal load, Gross Mass (GrW)=24,000 kg (52,910 Lbs)

Weight, TARE=2,200 Kg (4,850 Lb.)

Additional standards, relating to the containers data and to the required testing and marking are ISO 1496/V-1977(E)-1 and ISO 1496/1.

In our invention it is possible to combine up to 8 containers one on top of the other.

For the purpose of combining the containers to the sea/land transportation apparatuses (trains and trucks) and for connecting one container to the other, standard combining devices are used ('twist locks' ('connectors')) which are jointed to specific devices ('corner fittings') in the 8 corners of the container. These devices are also used for loading and unloading of the containers by a crane. An additional possibility for lifting empty or loaded containers is by fork-lift, for this purpose special devices are installed in the containers base ('fork lift pockets'). Their location and dimensions are defined by ISO STANDARD 668.

From this data it can be concluded that when combining 8 folded containers (to obtain a height of "HIGH CUBE" 40 feet) and with the maximal allowed load of 30,480 Kg, we obtain an accumulated load of 8 containers and the load of the four corners of the bottom containers is about 30,480 Kg×8/4=61,000 Kg.

The obtained load in the containers corner dictates the structural strength required for the static and dynamic load.

During transportation of vehicles in the sea/land going container, a vehicle (mostly private vehicles) may take up a relatively small volume in the sea/land going container, and at the same time does not allow for more than one vehicle to be placed into a standard 20 feet container and more than two vehicles into a 40 feet standard container. This increases the cost of transportation of the vehicle in the sea/land going container. The excess volume of the standard sea/land going container for the transportation of the vehicle is mainly a result of the height of the sea/land going container in relation to the height of the vehicle, but as stated before, the possibilities to locate the vehicles in the container are limited.

Therefore the aim of the present invention was to construct an improved sea/land going container to which a maximal number of vehicles can be loaded. The sea/land going container according to the present invention is simplified in production and operation, reduces the cost of vehicle transportation and yet complies with ISO STANDARDS 668 as described in the present invention.

SUMMARY OF INVENTION

The present invention solves the above problem by providing a sea/land going container for the transportation of one vehicle in 20 feet container and two vehicles in 40 feet container, but when connecting two of these sea/land going containers, one on top of the other, forming a new unit whose dimensions are those of a standard sea/land going container and the pair of the said sea/land going containers can be considered as one sea/land going container for purposes of storage and handling, thus as a standard sea/land going container. An additional advantage of this sea/land going container invention is that it does not include lateral walls and can be folded when transporting empty. The connection of 8 folded sea/land going containers—according to the present invention—one on top of the other, produces one unit that complies with all the requirements of the standards of a sea/land going container.

The present invention provides a sea/land going container system for transportation by sea and land of private vehicles the system is characterized by having one pair of sea/land going containers arranged one on top of the other, forming one unit sea/land going container with two levels, each of the containers comprises a transportation platform 1 for carrying vehicles, the unit having the dimensions and the structure complying with ISO STANDARD 668/1AAA, 668/1CC and ISO 1469/V, and each container having rail depressions 4 on the transportation platform for inserting the wheels of the vehicle; four beams 2, the beams are installed in the corners of the transportation platform, enabling the loading of an additional sea/land going container to form one unit by means of connectors 7, the beams are positioned in a state of unfolded or folded onto the transportation platform around a given axis inside an elongated rail depression, enabling the movement of the axis for coupling the beam with the transportation platform for transporting the sea/land going container when empty; at least one leaf-spring installed in the corners of the transportation platform and; knees, the knees are connected to each beam for pushing the leaf-spring when the beam is folded, the pushed leaf-spring is used as an auxiliary spring for pushing up the beam.

The present invention is of a sea/land going container for the transportation of a vehicle, with dimensions and structure, such that two of these sea/land going containers piled one on top of the other, form one sea/land going container with two levels, of the dimensions and structure of a sea/land going container required by ISO STANDARDTS. The sea/land going container (a single container), according to the present invention, has a height of 1435 mm (4 feet and 9 inches), width of 2,438 mm (8 feet) and a length of 6,058 (20 feet) or 12,192 mm (40 feet). Two of the said sea/land going containers piled on top of each other and connected together make one sea/land going container of a standard height of 2,896 mm (9 feet and 6 inches)—which is the known dimension of HIGH CUBE—and its width is 2,438 mm (8 feet) and the length is 6,058 mm (20 feet) or 12,192 mm (40 feet). The sea/land going container, according to the present invention, comprised of a transportation platform to carry the vehicle during transportation, rail depression of the transportation platform on which the wheels of the vehicle are inserted to increase the maximum possible height for transportation in such a sea/land going container and for the purpose of lashing anchoring the vehicle during transportation, four beams are installed in the corners of the transportation platform in a force structure enabling the loading of more sea/land going containers with the maximal allowed load (pay load) and connectors complying with ISO STANDARDTS in quantity and locations determined by the standard, for connecting the sea/land going containers one to the other for loading purposes and connecting to adjacent sea/land going containers or to means of transportation.

After loading the vehicles in both sea/land going containers of the present invention, one sea/land going container is put on top of the other and they are connected to each other. Two sea/land going containers become one unit sea/land going container complying with ISO STANDARD 668.

The four beams of the transportation platform may be folded on the transportation platform. Every beam folds on an axis installed in the elongated rail depression and after 90° folding it is possible to remove the beam together with the axis in the elongated rail depression and couple the beam together with the transportation platform. In this situation they form one unit of a folded sea/land going container, 362 mm (14.25 inch) high. Eight folded sea/land going containers, stored one on the other and connected one to the other form one unit complying with the requirements of the ISO STANDARDS 668 of one sea/land going container, and the eight empty sea/land going containers can be transported as one sea/land going container. Every beam has an auxiliary spring that helps to bring the beam back to the vertical position in order to use it for transportation of vehicles.

DEFINITIONS

For purposes of this specification and the accompanying claims, the term "connectors" refers to "corner fittings".

For purposes of this specification and the accompanying claims, the term "stabilizing pin" refers to "twist lock".

DRAWING DESCRIPTION

The present invention is described in detail in FIGS. 1 to 7. These figures are for descriptive purpose only and are not way intended to limit the scope of the invention in any manner.

Figure 1:
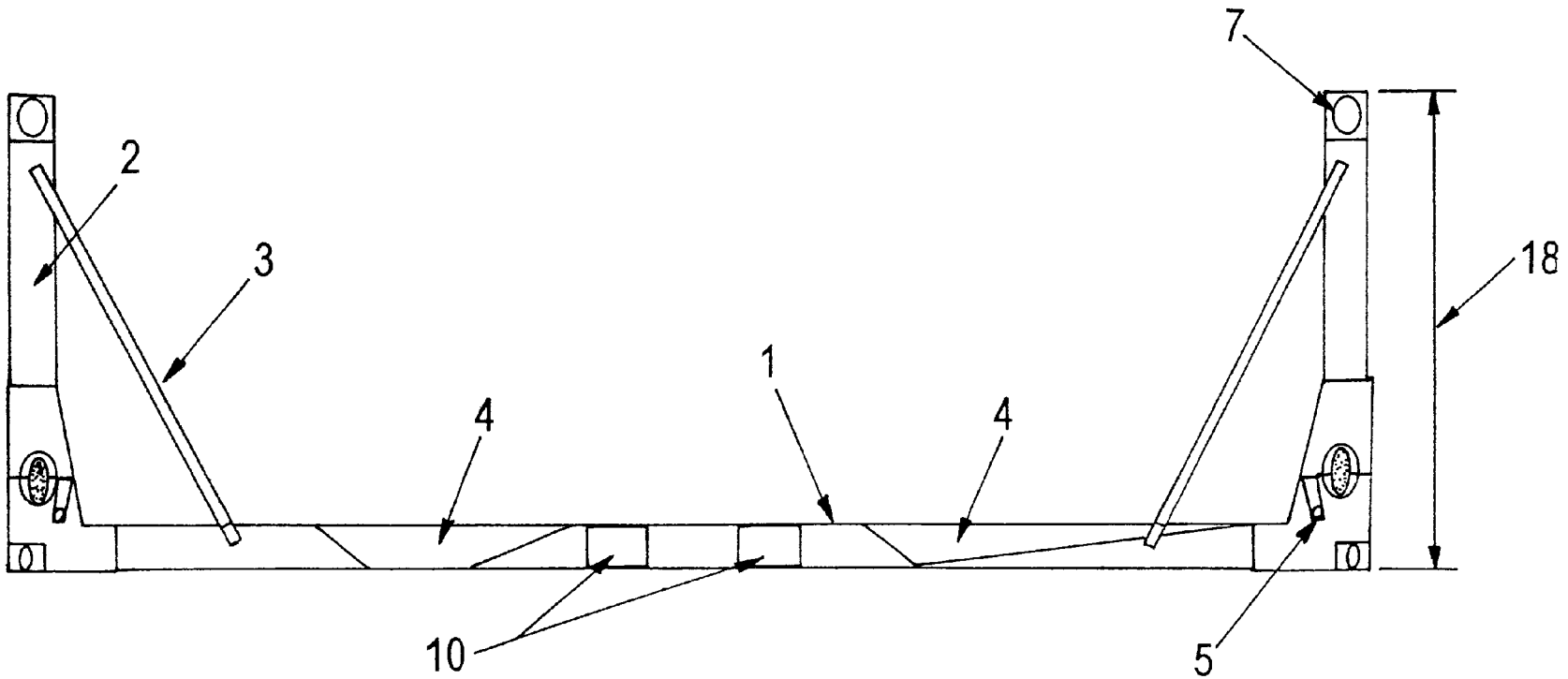
FIG. 1 shows the sea/land going container from the side.

FIG. 1 shows the sea/land going container from the side. The sea/land going container is made of a transportation platform 1 on which the vehicle is loaded for transportation. In the four corners of the sea/land going container, beams 2 are installed to support more sea/land going containers up to the load required by the ISO STANDATDS. The beams are supported by a diagonal bar 3 which can be folded together with the beams, while the beams can be folded at the axis 5. On the transportation platform are rail depression 4 on which the wheels of the loaded vehicle are inserted and it is possible to anchor the vehicle to the transportation platform. In all corners of the sea/land going container and in all external directions, according to ISO STANDATDS, are standard means of connectors (corner fittings) 7 enabling the connection of the sea/land going container to the next sea/land going container, to the loading machinery and to handling surfaces, e.g. a truck. On the sea/land going container are installed trenches 10 for loading purposes of the sea/land going container with the help of a forklift. The height of the sea/land going container 18 from the bottom of the transportation platform to the edge of the beams is 4 feet and 9 inches or 1435 mm.

Figure 2:
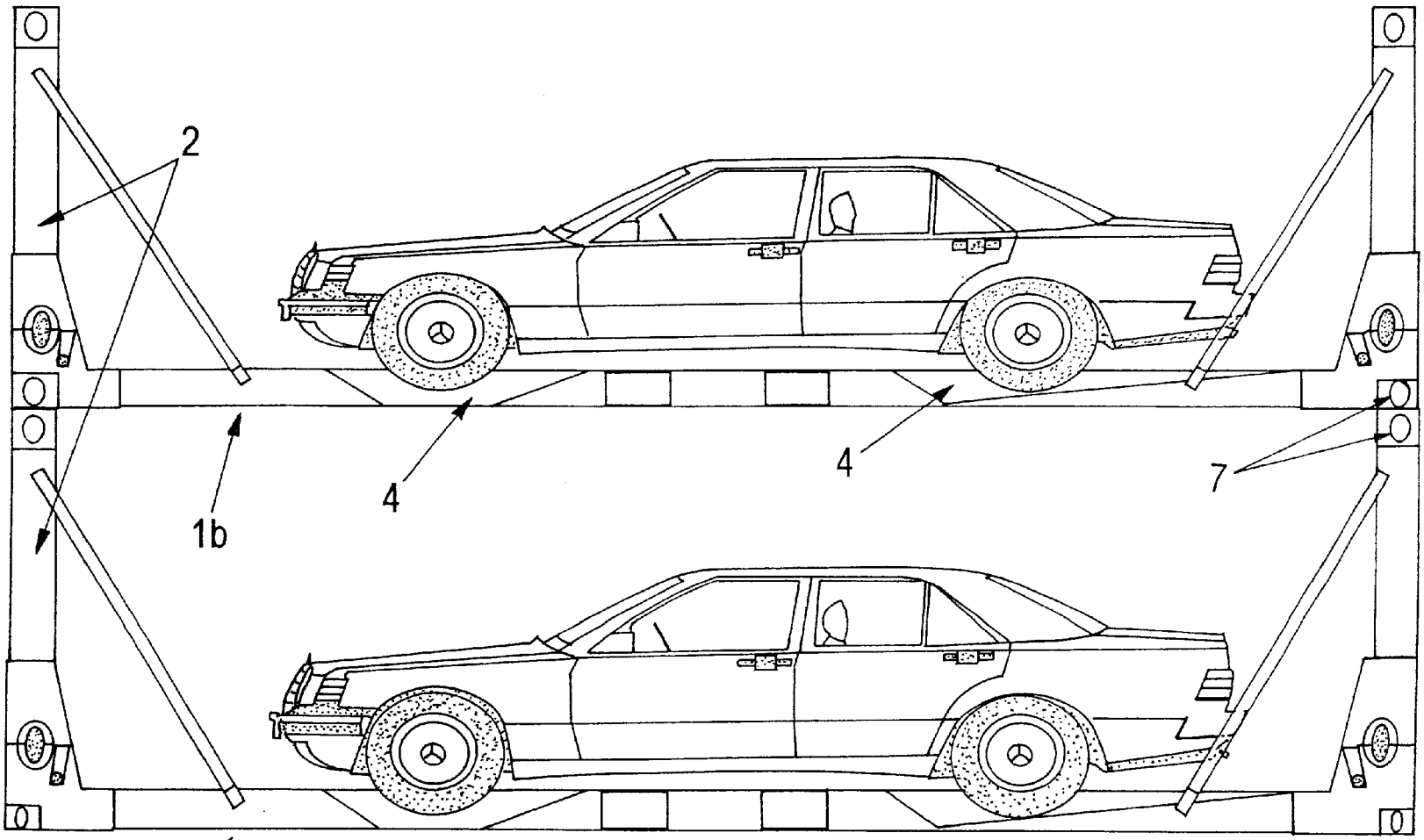
FIG. 2 shows a pair of sea/land going containers connected one to the other.

FIG. 2 shows a pair of sea/land going containers connected one to the other. When the sea/land going containers are loaded with a vehicle, the beams of the sea/land going container 2 are in a vertical position, relative to the transportation platform and the beams can support the sea/land going container on top 1*b* on the sea/land going container below 1*a* and connect them together with connectors (corner fittings) 7. The vehicle rests on the transportation platform with its wheels anchored in the rail depression 4 of the transportation platform. The two sea/land going containers make up one unit with dimensions and resistance that comply with the ISO STANDATDS of a sea/land going container.

Figure 3:
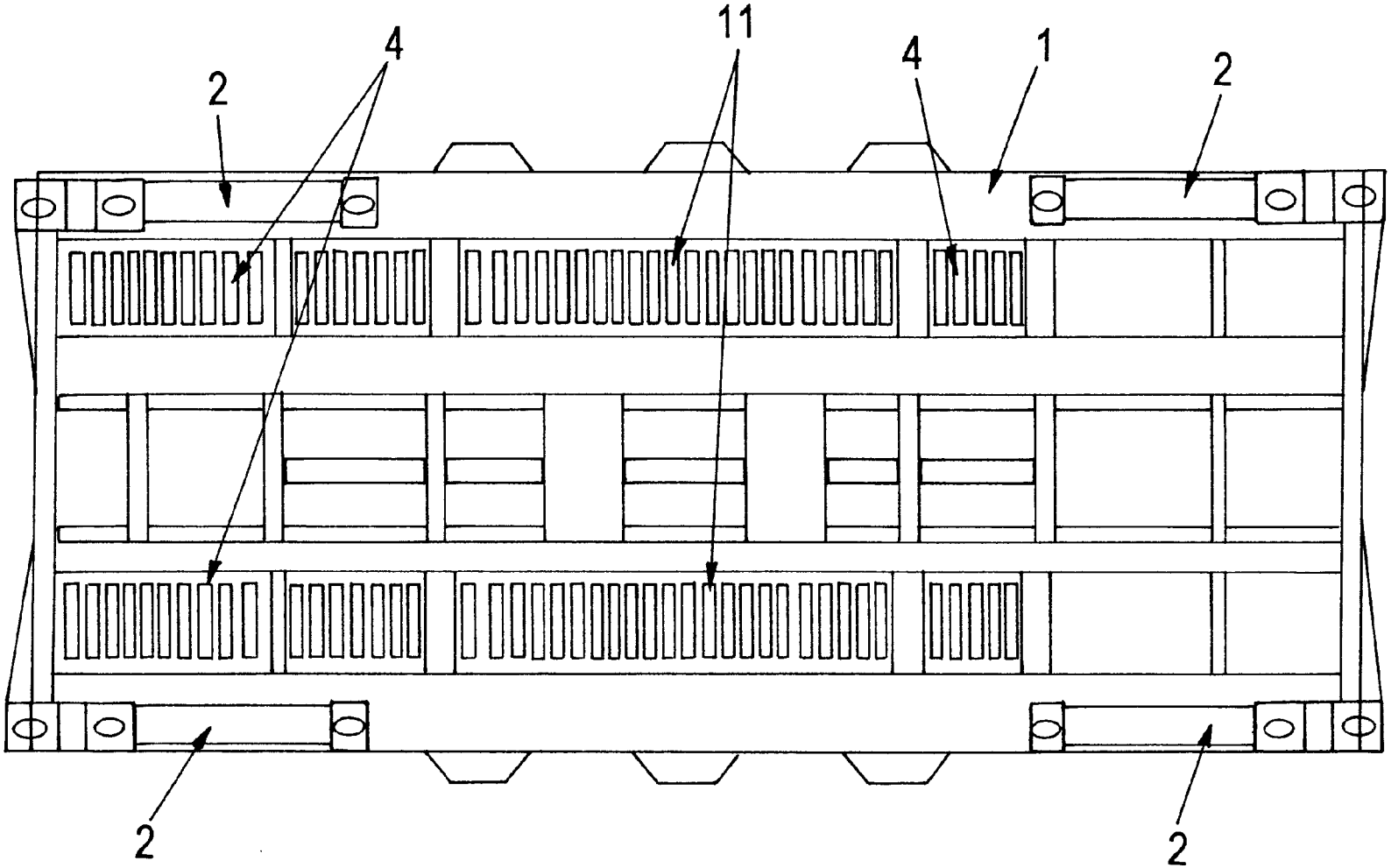
FIG. 3 shows the sea/land going container from the top with folded beams.

FIG. 3 shows the sea/land going container from the top with folded beams. The transportation platform 1 can support a load of 5 tons, corresponding to the load of vehicles. The vehicle is transported on the trade's 11 and the wheels of the vehicle are inserted and anchored to the rail depression 4 of the transportation platform. In the four corners of the transportation platform, beams 2 are erected, those are shown in this figure as folded. To use the sea/land going container the beams are placed straight up and locked onto the transportation platform and consequently these beams can support a load that complies with the ISO standard requirement.

Figure 4:
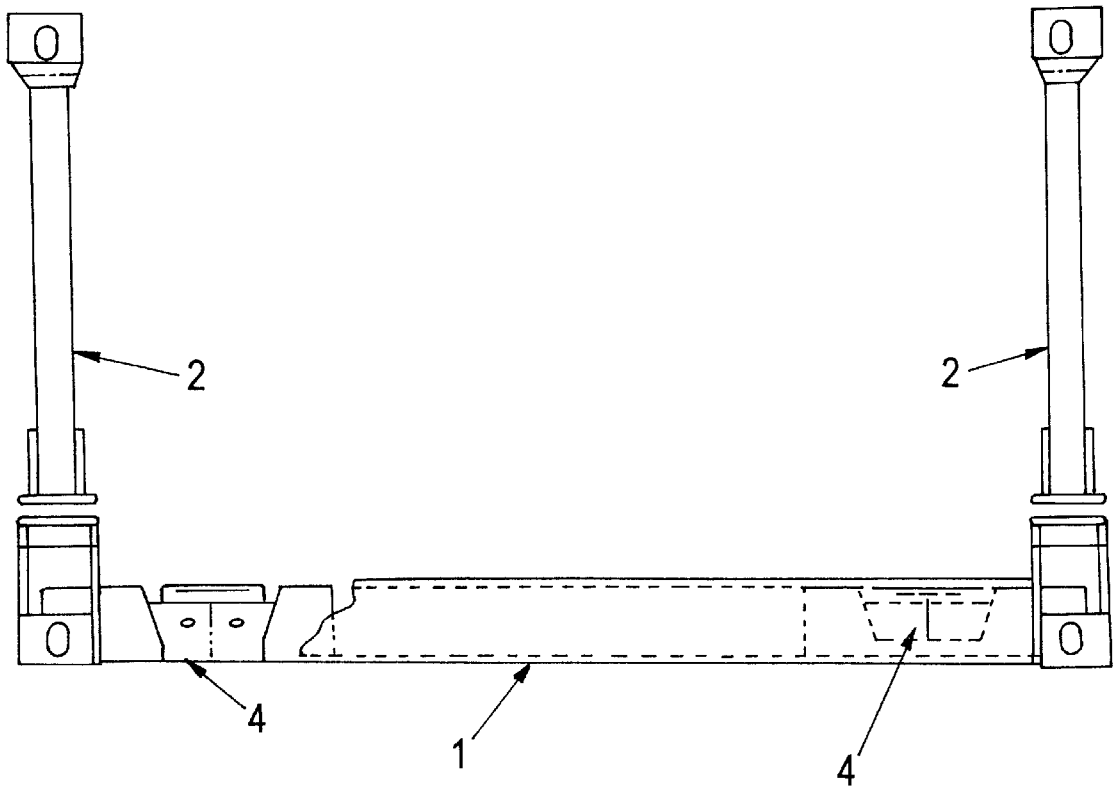
FIG. 4 shows a rear view of the sea/land going container.

FIG. 4 shows a rear view (from both sides) of the sea/land going container. The beams 2 are unfolded (in a vertical position). The vehicle enters the transportation platform 1 and the wheels sink and are anchored into the rail depression 4 of the transportation platform (seen in FIG. 1).

Figure 5:
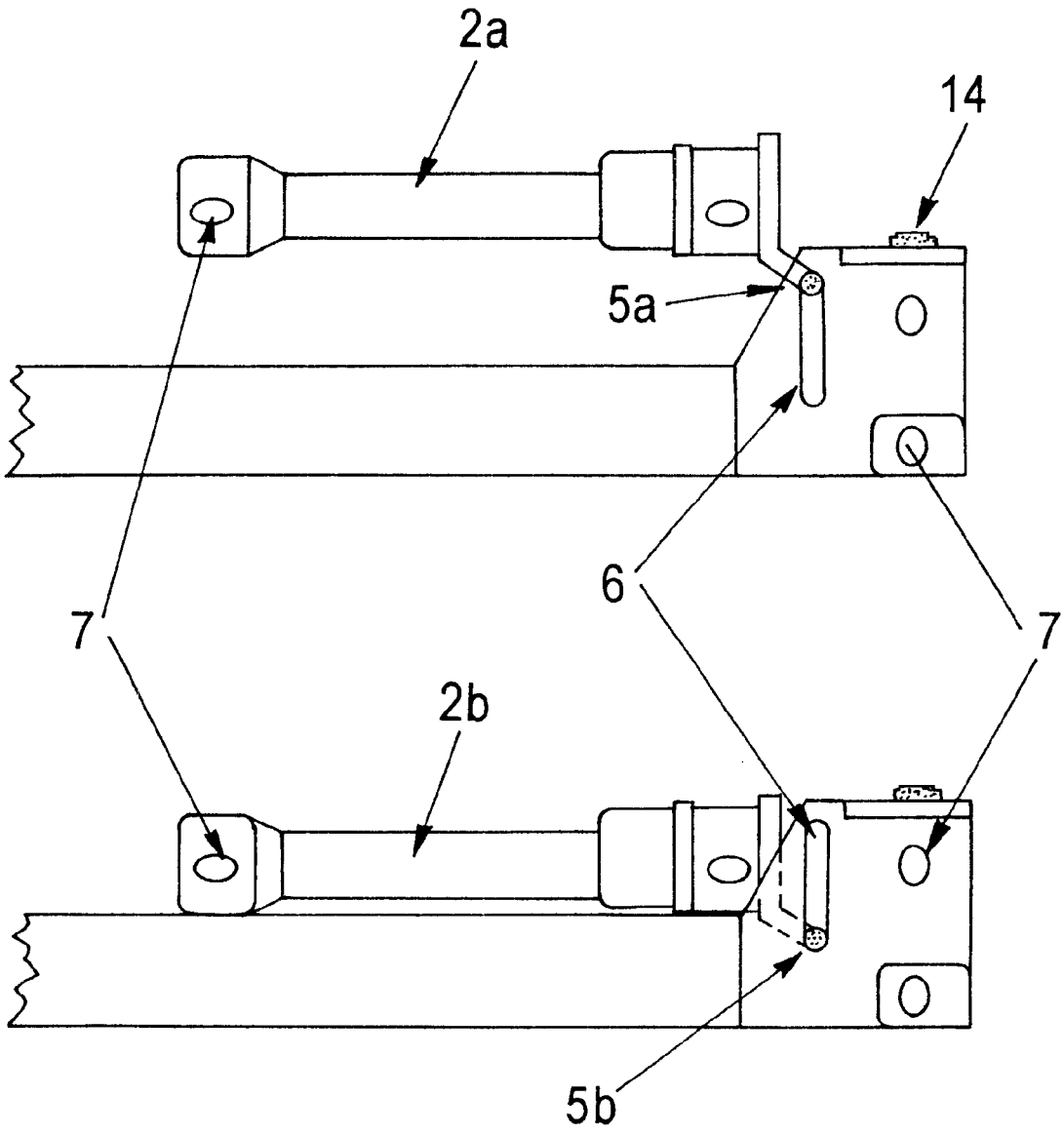
FIG. 5 shows how to fold the beams in the sea/land going container.

FIG. 5 shows how to fold the beams in the sea/land going container. When the sea/land going container is empty, it is possible to fold the beams and connect 8 sea/land going containers, one on top of the other and thus connect them to obtain one unit of the dimensions and strength of one standard sea/land going container. For folding purposes the beam is freed from the stabilizing pin (twist lock) 14 and from the standard connector (corner fitting) 7 by which it was connected to the transportation platform. The beam is folded in a horizontal position 2*a* while the beam rotates on the upper axis 5*a*. The beam is lowered onto the transportation platform in position 2*b* with its axis lowered onto the elongated rail depression 6 until it reaches a new position 5*b*. In this situation, when the beams are coupled with the transportation platform, the height of the folded sea/land going container is 362 mm (14.25 inches) and 8 such sea/land going containers reach the height of one sea/land going container complying with ISO STANDADS 668.

Figure 6:
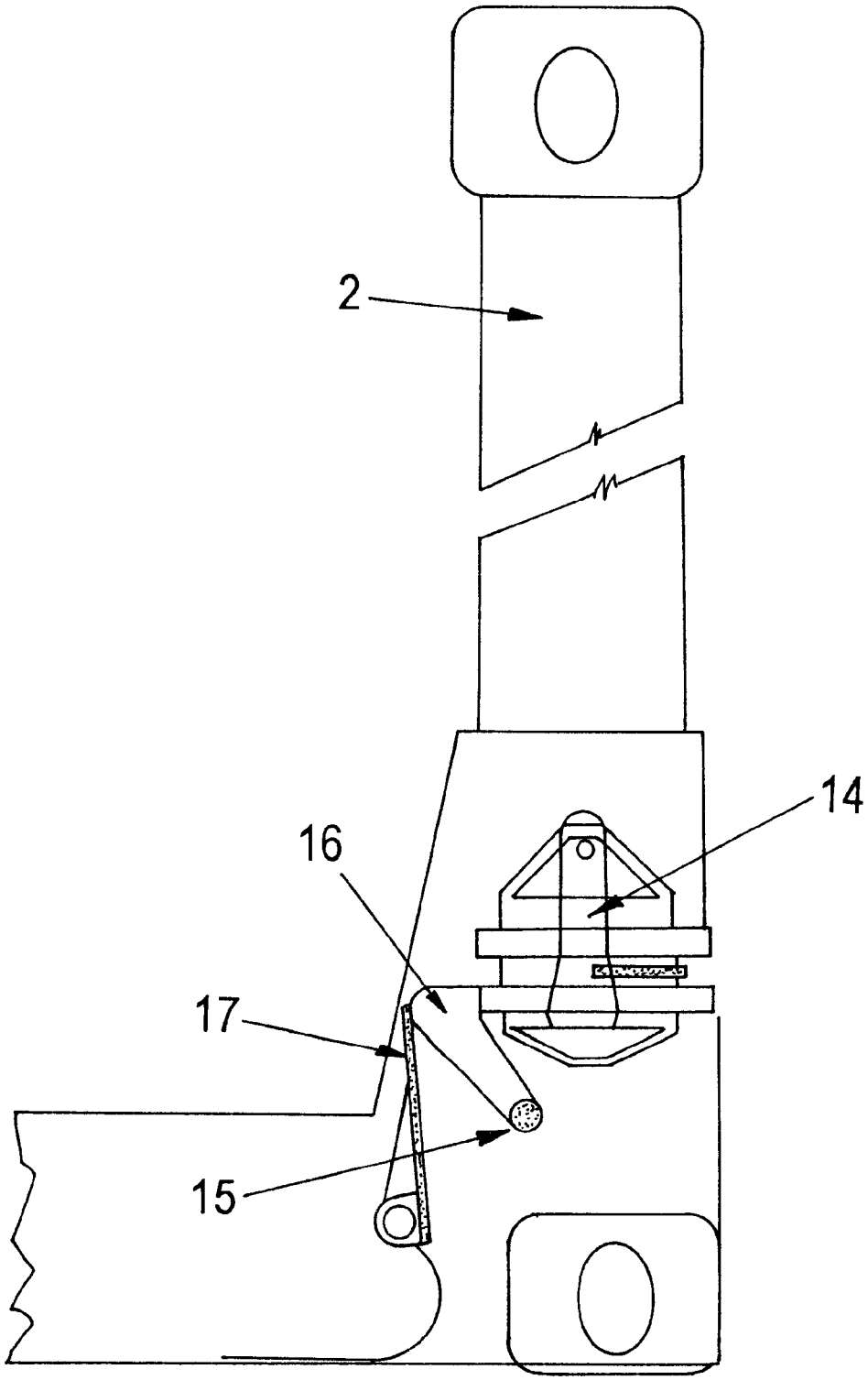
FIG. 6 shows a beam with an auxiliary spring.

FIG. 6 shows a beam with an auxiliary spring. The beam 2 has a knee 16, which rotates with the beam while folded. A leaf spring 17, comprised of a plate and spring, is installed in the transportation platform and released when the beam is in a vertical position. When the beam is folded the knee 16 rotates and pushes the leaf spring 17. The pushed leaf spring is an auxiliary spring for help to raise the beam back to a vertical position. In a purpose of folding the beam, the fast twist lock 14 is released and the beam pushed down, around the given axis 17, to a horizontal position on the transportation platform.

Figure 7:
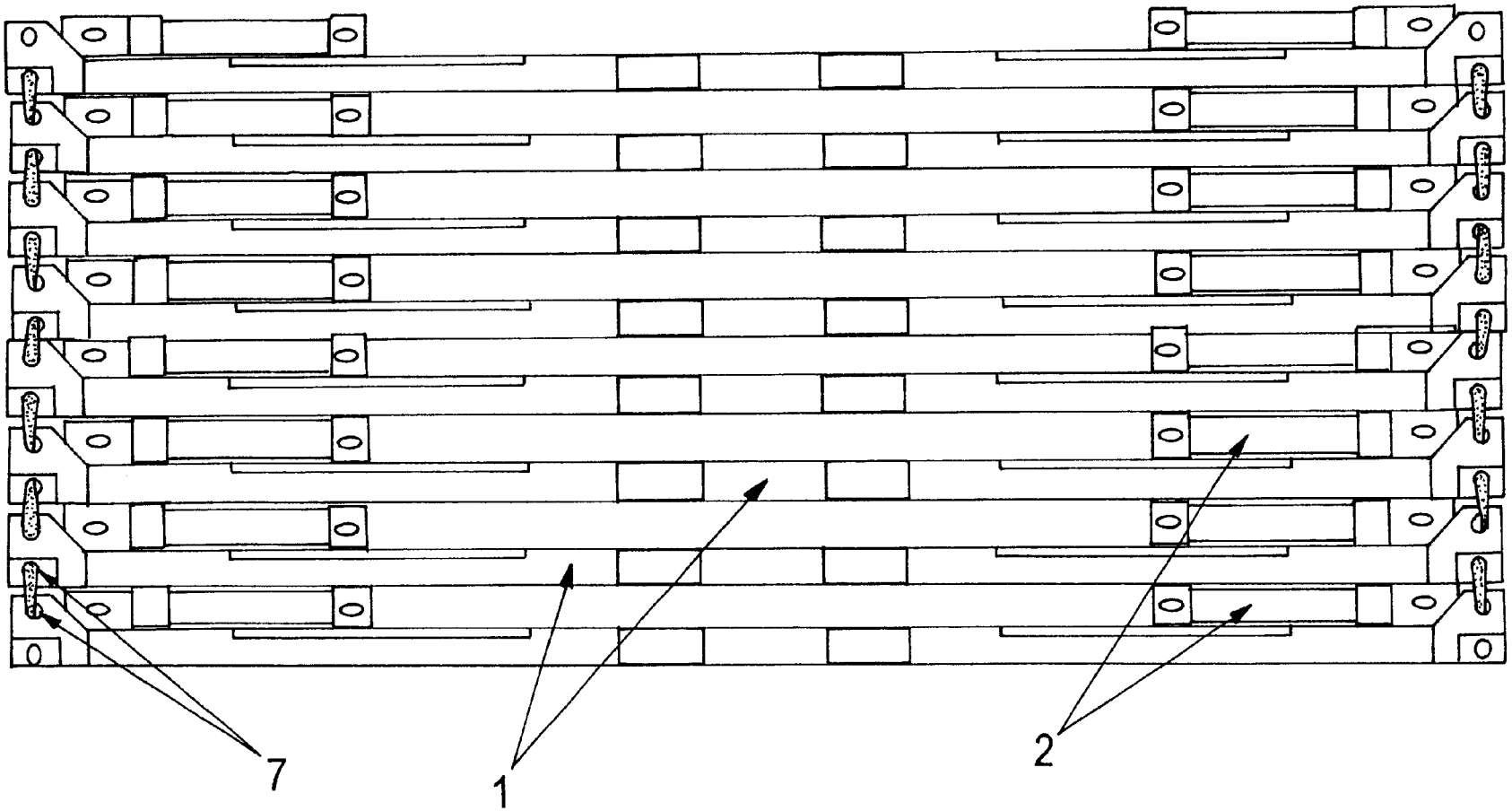
FIG. 7 shows how to transport the empty folded sea/land going containers.

FIG. 7 shows how to transport the empty folded sea/land going containers. After the beams 2 of each sea/land going container have been folded, the transportation platforms 1 are piled one on top of the other and connected together with standard connectors (corner fittings) 7. Eight sea/land going containers together, one on top of the other, form one unit with the dimensions and the strength of one sea/land going container, complying with ISO STANDARDS.

What is claimed is:

1. A container system for transportation of vehicles by sea or land, said system comprising a pair of containers arranged one on top of the other to form a single container unit with two levels;

wherein each of said containers comprises:

a transportation platform (1) for carrying at least one vehicle;

a plurality of rail depressions (4) on the transportation platform for receiving the wheels of the at least one vehicle;

four foldable beams (2) installed in the corners of the transportation platform, each of said beams being pivotable between a unfolded state and a folded state about a hinge movably received in an elongated depression;

at least one leaf-spring (17) installed in each of the corners of the transportation platform;

at least one knee connected to each of said beam for pushing the corresponding leaf-spring down when the beam is folded, the pushed leaf-spring biasing the beam and being used as an auxiliary spring for pushing up the beam to the unfolded state; and connectors (7) for connecting said pair of containers to each other; and wherein, when said containers are stacked one upon another which the beams in the unfolded state, said unit has dimensions and structures complying with ISO STANDARD 668/1AAA, 668/1CC and ISO 1469/V.

2. The sea/land going container system according to claim 1, wherein the height of one sea/land going container from the bottom of the transportation platform to the edge of the unfolded beams including the connectors is 1448 mm (4 feet and 9 inches), its width is 2438 mm (8 feet), its length is 12,192 mm or 6,058 mm (40 or 20 feet), and its strength enables loading of 30,480 Kg or 24,000 Kg.

3. The sea/land going container system according to claim 2, for use for loading the vehicle to the container and unloading the vehicle from the container from both sides while driving, without the means of mechanical accessories.

4. The sea/land going container system according to claim 1, wherein the height of the sea/land going container from the bottom of the transportation platform to the edge of the folded beams is 362 mm (14.25 inches), its width is 2,438 cm (8 feet), its length is 12,192 mm or 6,058 mm (40 or 20 feet), and its strength enables loading of 30,480 Kg or 24,000 Kg.

5. The sea/land going container system according to claim 4, for use for loading the vehicle to the container and unloading the vehicle from the container from both sides while driving, without the means of mechanical accessories.

6. The sea/land going container system according to claim 1, wherein said system comprises eight foldable containers forming size of one unit having the dimensions and the structure complying with ISO STANDARD 668/1AAA and 668/1CC.

7. The sea/land going container system according to claim 6, for use for loading the vehicle to the container and unloading the vehicle from the container from both sides while driving, without the means of mechanical accessories.

8. The sea/land going container system according to claims 1, for use for loading the vehicle to the container and unloading the vehicle from the container from both sides while driving, without the means of mechanical accessories.

9. The container system of claim 1, wherein said elongated depression extending in an upright direction with respect to the transportation platform.

10. The container system of claim 1, wherein said folded state comprises an intermediate folded state and a final folded state;

each of said beams is pivotable between said unfolded state and said intermediate folded state about the hinge when the hinge is at an upper position in the elongated depression; and each of said beams is raised/lowered between the intermediate folded state and the final folded state when the hinge is moved between the upper position and a lower position in the elongated depression.

11. The container system of claim 1, wherein said container further comprising diagonal bars for fortifying said beam in said unfolded state.

12. The container system of claim 1, wherein said container, while being in said unfolded state, is open at all four sides thereof to allow entry of the at least one vehicle to be carried into said container from either of longitudinally opposite ends of said container.

13. The container system of claim 1, wherein said connectors are installed in the corners of the transportation platform at upper and lower locations, and in an upper end of each of said beams.

14. The container system of claim 13, wherein said containers are stacked one upon another in a working state when the beams are in the unfolded state and the connectors at the lower locations on the transportation platform of one of said containers are connected to the connectors in the upper ends of the beams of the other container; and said containers are stacked one upon another in a unused state when the beams are in the folded state and the connectors at the lower locations on the transportation platform of one of said containers are connected to the connectors at the upper locations on the transportation platform of the other container.

15. A container for use in a container system for transportation of vehicles by sea or land, said container comprising:

a transportation platform for carrying at least one vehicle;

a plurality of rail depressions on the transportation platform for receiving the wheels of the at least one vehicle; and four foldable beams installed in the corners of the transportation platform, each of said beams being pivotable between a unfolded state and a folded state about a hinge movably received in an elongated depression wherein:

said folded state comprises an intermediate folded state and a final folded state;

each of said beams is pivotable between said unfolded state and said intermediate folded state about the hinge when the hinge is at an upper position in the elongated depression; and each of said beams is raised/lowered between the intermediate folded state and the final folded state when the hinge is moved between the upper position and a lower position in the elongated depression;

said container further comprising:

at least one spring installed in each of the corners of the transportation platform; and at least one knee connected to each of said beam for loading the corresponding spring when the beam is folded, the loaded spring biasing the beam and being used as an auxiliary spring for pushing up the beam to the unfolded state.

16. The container of claim 15, wherein said elongated depression extending in an upright direction with respect to the transportation platform.

17. The container of claim 15, wherein said container further comprising diagonal bars for fortifying said beam in said unfolded state.

18. The container of claim 15, wherein said container, while being in said unfolded state, is open at all four sides thereof to allow entry of the at least one vehicle to be carried into said container from either of longitudinally opposite ends of said container.

19. The container of claim 15, further comprising connectors for connecting multiple said containers to each other, said connectors being installed in the corners of the transportation platform at upper and lower locations and in an upper end of each of the beams.

20. The container of claim 15, wherein said spring is a leaf spring and the corresponding knee pushes the leaf-spring down when the corresponding beam is folded.

* * * * *